US007431401B2

(12) United States Patent
Weβelmann et al.

(10) Patent No.: US 7,431,401 B2
(45) Date of Patent: Oct. 7, 2008

(54) SLIDE SHOE FOR MINING WINNING MACHINE

(75) Inventors: Johannes Weβelmann, Dortmund (DE); Markus Lenzing, Lüdinghausen (DE); Sebastian M. Mundry, Lüdinghausen (DE); Gerhard Merten, Lünen (DE); Martin Broszat, Nordkirchen (DE)

(73) Assignee: DBT GmbH (DE)

( * ) Notice: Subject to any disclaimer, the term of this patent is extended or adjusted under 35 U.S.C. 154(b) by 114 days.

(21) Appl. No.: 11/563,731

(22) Filed: Nov. 28, 2006

(65) Prior Publication Data

US 2007/0194618 A1 Aug. 23, 2007

(30) Foreign Application Priority Data

Nov. 28, 2005 (DE) ..... 20 2005 018 614 U

(51) Int. Cl.
*E21C 35/12* (2006.01)

(52) U.S. Cl. ..... 299/1.4; 299/1.05

(58) Field of Classification Search ..... 29/1.05, 29/1.4, 1.6

See application file for complete search history.

(56) References Cited

U.S. PATENT DOCUMENTS 6,960,922 B2 * 11/2005 Klaar ..... 324/723

FOREIGN PATENT DOCUMENTS

DE 195 31 729 A1 8/1996
DE 20 2004 000 516 U1 5/2004

* cited by examiner

*Primary Examiner*—John Kreck
(74) *Attorney, Agent, or Firm*—Baker & McKenzie LLP

(57) ABSTRACT

A slide shoe for a mining winning machine is disclosed. The slide shoe includes a slide shoe body attached to the mining winning machine, a sliding area located on the slide shoe body and including a wear thickness, and at least one sensor. The sensor is scannable by wireless signal transmission. A dimension of the wear thickness decreases due to wear during operation, and a sensor signal of the sensor changes when the dimension of the wear thickness of the sliding area decreases below a predetermined minimum thickness.

9 Claims, 1 Drawing Sheet

SLIDE SHOE FOR MINING WINNING MACHINE

CROSS-REFERENCE TO RELATED APPLICATION

Figure 1:
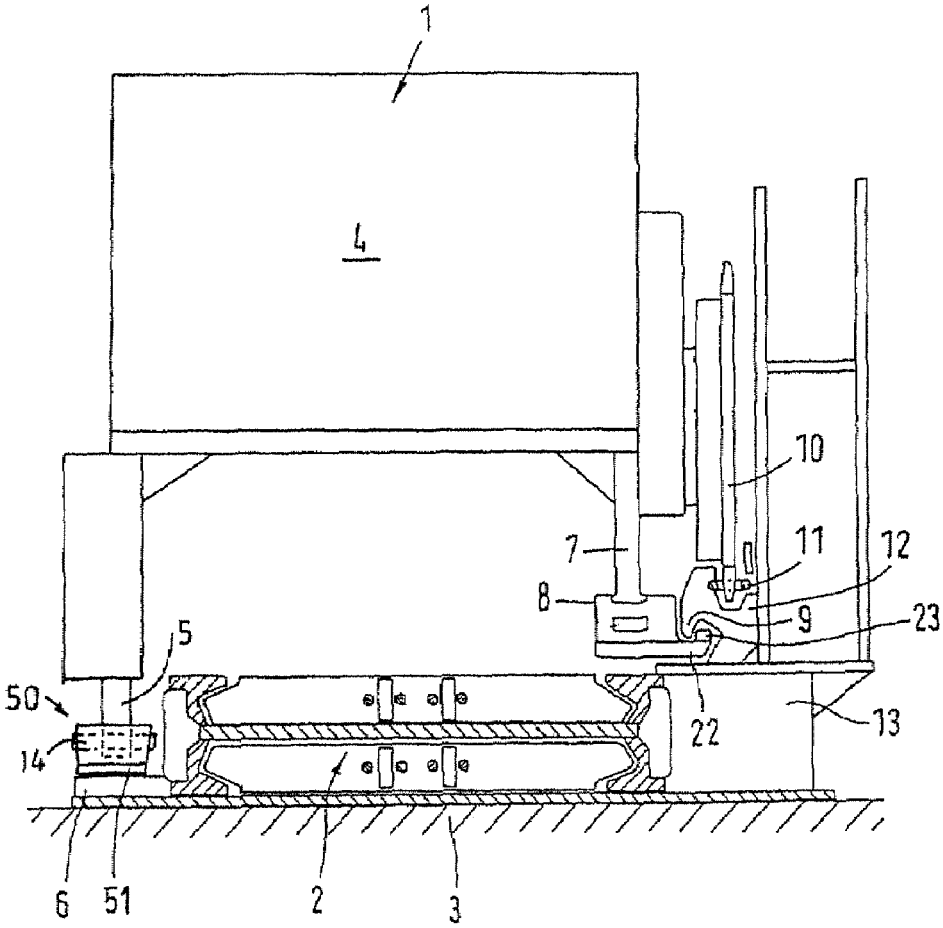

This application claims priority to German Patent Application No. 20 2005 018 614.7 filed on Nov. 28, 2005.

The invention relates to a slide shoe for supporting and/or guiding a mining winning machine, in particular a shearer loader, on a slideway, having a slide shoe body which can be interchangeably fixed to the mining winning machine and has a sliding area formed with a wear thickness, which decreases due to wear during operational use.

In underground mining, mining winning machines such as, in particular, coal plows or shearer loaders, are guided on guides which are attached to a conveyor on the goaf side and/or on the working-face side. In the case of modern shearer loaders, it is normal practice for a rack element to be arranged on the (goaf) side of the conveyor remote from the coal face, this rack element consisting, for example, of toothed or rack bars or preferably of a rack-type chain, and engaging in said rack element is a drive wheel mounted on the body of the shearer loader. At the same time, the shearer loader is guided in the vertical and lateral directions on a suitable machine guide on both the goaf side and the working-face side by means of guide elements, which in particular may consist of guide shoes.

From DE 195 31 729 A1, for example, it is known in the case of a shearer loader that the guide elements on the working-face side may consist of both slide shoes and guide rollers. A slide shoe or a slide skid for a winning plow has been disclosed by DE 20 2004 000 516 U1.

At least one of the slide shoes with which the mining winning machine is guided on a guide must bear a large proportion of the weight of the winning machine. These slide shoes supporting the weight are therefore subject to especially high wear and the sliding area of these slide shoes is designed with a sufficient wear thickness, which decreases as a function of wear in operational use. The wear on these weight-bearing slide shoes is often especially high, since rock fragments or the like, which in contrast to coal do not produce any sliding lubrication, partly get between the slide shoes and the guide. The service life of the slide shoes therefore cannot be estimated even by means of intensive calculations. Since at the same time access to the slide shoes is only possible with difficulty and a visual inspection is scarcely possible, relatively short wear intervals have to be selected for the slide shoes. Slide shoes in which there would still be sufficient wear thickness are therefore exchanged frequently.

The object of the invention is to provide slide shoes for mining winning machines in which the abovementioned problems are removed.

This object is achieved according to the invention in that at least one sensor which can be scanned by wireless signal transmission is assigned to the sliding area of the slide shoe, the sensor signal of said sensor changing at least if the wear thickness of the sliding area decreases below a minimum thickness. In the solution according to the invention, the slide shoes, by the attachment of sensors, are instrumented or become automatically readable in such a way that the exceeding of a wear limit due to the wear dropping below a minimum thickness can be automatically detected. Wireless signal transmission ensures that the state of the sensor can be read out at a sufficient distance and thus without error and without being susceptible to malfunctions, as a result of which the sensor is not exposed to the risk of being separated in any way from the scanning unit or the like. The slide shoe itself can therefore remain a component of simple design without connecting lines, plugs, plug connections and the like, since the signal transmission is effected wirelessly.

According to an especially preferred configuration, the sensor is designed as a destruction sensor, which is destroyed if the thickness falls below the minimum thickness. The use of such a destruction sensor has the special advantage that all the signal states of the sensor can be reliably determined; therefore information can always be available as to whether the sensor is still indicating a signal, whether a short-circuit state is possibly present or else whether the thickness has fallen below the minimum thickness on account of the destruction of the sensor.

According to an especially preferred configuration, sensor electronics are assigned to the sensor and preferably regularly scan the sensor at predetermined time intervals. For example, the sensor can be scanned in a one-minute or multi-minute cycle and in the process exchange a data packet having signals of its operating status and, for example, an identification number with the sensor electronics, which then wirelessly transmit the corresponding sensor signal to a control unit assigned to the winning machine, support shields or the end region of longwalls. The sensor electronics are in this case preferably provided with a battery, with which the sensor is also fed. The service life of the battery should be sufficient for a slide shoe to have a sufficient service life starting from the first time the sensor is activated. The batteries may consist of simple, possibly even commercially available battery cells, such as microcells for example. Furthermore, the sensor electronics may be preferably provided with a processor and/or an antenna, in particular an antenna integrated in the electronics, such as a PCB antenna, so that, with little outlay in terms of electronics, the signals of the sensor can be analyzed and transmitted wirelessly as a data packet. The sensor electronics are preferably arranged at a distance from the sensor in a receptacle or cutout in the slide shoe body. The sensor and/or the sensor electronics may in particular be arranged in a recess, cutout or hole which extends in a section of the slide shoe body arranged at the back of the sliding area. Advantageously only the sensor, with its sensor tip intended for destruction when the minimum thickness is reached, extends right up to the minimum thickness of the sliding area.

Furthermore, the sensor electronics can preferably be activated/deactivated wirelessly in order to prolong the service life of the battery. Furthermore, it is advantageous if the sensor and/or the sensor electronics are encapsulated in casting compound.

Figure 2:
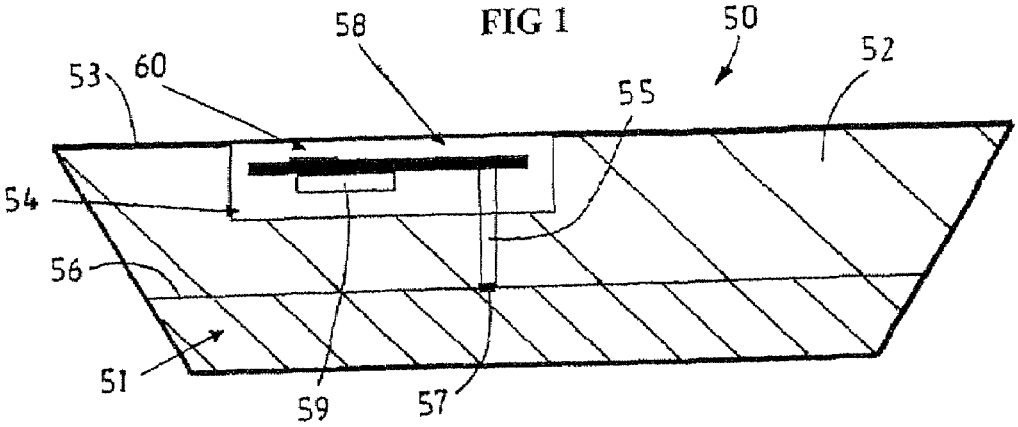

Further advantages and configurations of the invention follow from the description below of an exemplary embodiment, shown schematically in the drawing, of a shearer loader having a slide shoe according to the invention. In the drawing:

FIG. 1 shows in a schematically simplified manner a shearer loader guided in guides on a conveyor on the goaf side and on the working-face side in a view in the longitudinal direction of a conveyor; and FIG. 2 schematically shows a slide shoe according to the invention having an integrated wear sensor.

FIG. 1 shows in a highly schematically simplified manner a mining winning system known per se having a shearer loader 1 as mining winning machine and a conveyor 2 which is arranged on the floor 3 inside the underground winning plant in front of a coal face (not shown), at which coal is extracted. Of the shearer loader 1, essentially only its machine body 4 is shown, which extends across the conveyor 2 in a portal-like manner and which, on that side of the conveyor 2 which faces the coal face, is supported by means of slide shoes 50 on a running rail 6 which is arranged laterally on the conveyor 2 in a fixed position. In this case, the general arrangement drawing in FIG. 1 shows only the front slide shoe of usually a plurality of slide shoes 50. The slide shoes 50 are pivotally supported within limits by means of a pin 14 on a guide arm 5 on the working-face side, and most of the weight of the machine body 4 of the shearer loader 1 is supported via the slide shoes 50 sliding along the slideway 6 in operational use.

On the opposite side (goaf side), the machine body 4 has a respective guide arm 7 in the region of its two ends, and pivotally arranged on the bottom ends of said guide arms 7 is a respective guide shoe 8, which is guided on a guide strip 9, in particular as a lateral guide for the shearer loader 1. Furthermore, on its machine body 4, the shearer loader 1 has a travel drive having at least one toothed or rack wheel 10 which is in tooth engagement with a rack-type chain 11 which is mounted on a supporting rail 12. In the exemplary embodiment shown, the supporting rail 12 at the same time forms the guide strip 9 for the lateral guidance of the shearer loader 1. The supporting rail 12 is firmly arranged on brackets 13 which are attached to the conveyor 2 on the goaf side. For the lateral guidance of the shearer loader 1 by means of the guide shoe 8, the underside of the latter has a hook strip 22 having a guide hook 23 which projects upwards and catches behind the guide strip 9 in a slot recess.

In particular the slide shoes 50 on the working-face side sliding along on the slideway 6 are subjected to especially high wear, since the material extracted by the shearer loader 1 can also obstruct the slideway 6. On their underside, therefore, the slide shoes 50 have a sliding area 51 formed with sufficient wear thickness, it being possible for this wear layer to preferably consist of material having greater wear resistance or of inserts having greater wear resistance, or the like, which extend completely or only partly over the sliding area 51.

According to the invention, the slide shoes 50 are provided with a sensor device (not shown in FIG. 1) which permits wireless detection of the thickness of the sliding area 51 or of the wear state of the sliding area 51. The construction and arrangement of this sensor device will now be explained with reference to FIG. 2.

FIG. 2, in a purely schematic manner, shows a slide shoe 50 according to the invention, in particular for a shearer loader. The slide shoe 50 comprises a relatively bulky slide shoe body 51 having a sliding area 51 (shown relatively thick here) on its underside. The sliding area 51 may also consist of a surfacing layer or of a wear insert or the like. The receptacle for a guide arm of the mining winning machine and/or a pivot pin or the like is not shown. Formed on the top side 53 of the slide shoe body 52 is a cutout or recess 54, from which a vertical hole 55 extends right up to the limit 56 (depicted here as a line) between the slide shoe body 52 and the start of the sliding area 51. Here, the line 56 symbolizes a minimum thickness for the wear thickness of the sliding area 51. Arranged at the bottom of the hole 51 is a sensor element 57, which consists of a destruction sensor, which is designed to be damaged or destroyed if the sliding area 51 is worn to a greater extent than the predetermined minimum thickness and therefore the line 56 is exceeded due to wear. Via a connecting cable or the like, the sensor 57 is connected to sensor electronics 58 which comprise a miniature processor and/or transceiver electronics on a circuit board or the like. The sensor electronics 58 are fed by means of a battery 59, which is arranged together with the circuit board in a recess or cutout 54 on the top side of the slide shoe body 52. In addition, the sensor electronics 58 are provided with a schematically shown PCB antenna 60 so that the sensor signals scanned at certain time intervals at the sensor 57 by the sensor electronics 58 can be transmitted wirelessly to a receiver, which is assigned, for example, to a control unit of the mining winning machine or to the control units of support shields or the like. As long as the sensor 57 sends a signal or supplies a response signal, the sensor electronics 58 can transmit this information to the analyzing electronics via the antenna 60, and an exchange of the slide shoe 50 is not necessary. However, if the sliding area 51 sinks below the minimum wear thickness (line 56), the sensor 57 is destroyed in such a way that it no longer supplies a signal. The failure of the signal is then detected and the analyzing electronics can indicate to the operating personnel that an exchange of the slide shoes 50 must now take place. It goes without saying that there should still be a sufficient safety thickness at the sliding area 51 which can ensure operation of the winning machine at least until the next maintenance shift.

The batteries may be designed, for example, for a certain service life of two to three years, it being possible for a correspondingly long service life of the batteries 59 to be ensured by the power consumption of the sensor electronics and of the sensor 57 being sufficiently low at certain scanning intervals. However, the sensor electronics could also be set up with automatic switch-off or switch-on means, which must be activated at the start of operational use of the slide shoe. This activation can also preferably be effected wirelessly.

The person skilled in the art can deduce numerous modifications which ought to come within the range of protection of the attached claims. The figures show a slide shoe on the working-face side on a shearer loader. Wear sensors according to the invention could also be used on the guide shoe on the goaf side and/or on slide shoes or slide skids of winning plows. A plurality of sensors could also be arranged on the slide shoe in order to be able to indicate wear-related replacement of the slide shoe even during uneven wear of the sliding area.

The invention claimed is:

1. A slide shoe for a mining winning machine, comprising:

an exchangeable slide shoe body attached to the mining winning machine;

a sliding area located on the slide shoe body, the sliding area including a wear thickness; and at least one sensor, the at least one sensor being scannable by wireless signal transmission, wherein a dimension of the wear thickness decreases due to wear during operation; and a sensor signal of the sensor changes when the dimension of the wear thickness of the sliding area decreases below a predetermined minimum thickness.

2. The slide shoe of claim 1, wherein the sensor includes a destruction sensor; and the sensor is destroyed when the dimension of the wear thickness falls below the minimum thickness.

3. The slide shoe of claim 1, further comprising sensor electronics associated with the at least one sensor, wherein the sensor electronics scan the at least one sensor at predetermined time intervals.

4. The slide shoe of claim 3, wherein the sensor electronics include at least a battery.

5. The slide shoe according to claim 3, wherein the sensor electronics include at least a processor, an antenna, or a combination thereof integrated in the sensor electronics.

6. The slide shoe of claim 3, further comprising at least one of a cutout or a receptacle located in the slide shoe body, wherein the sensor electronics are located a predetermined distance from the at least one sensor and in the cutout or the receptacle.

7. The slide shoe of claim 3, wherein at least one of the at least one sensor or the sensor electronics is located in at least one of a recess, a cutout, or a hole extending in a section of the slide shoe body located at a back of the sliding area.

8. The slide shoe of claim 3, wherein the sensor electronics are activated and deactivated wirelessly.

9. The slide shoe of claim 3, wherein at least one of the at least one sensor, the sensor electronics, or a combination thereof are encapsulated in a casting compound.

* * * * *